US007091433B2

(12) United States Patent
Meagher et al.

(10) Patent No.: US 7,091,433 B2
(45) Date of Patent: Aug. 15, 2006

(54) LOW PROFILE AUTOMOTIVE LATCH RELEASE SWITCH ASSEMBLY

(75) Inventors: James P. Meagher, Indianapolis, IN (US); Thomas A. Neese, Alexandria, IN (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/944,446

(22) Filed: Sep. 17, 2004

(65) Prior Publication Data

US 2006/0060458 A1 Mar. 23, 2006

(51) Int. Cl.
*H01H 35/02* (2006.01)

(52) U.S. Cl. ..... 200/61.45 M

(58) Field of Classification Search ..... 200/5 A, 200/5 R, 5 E, 310–314, 510–520, 341, 85 R, 200/61.58 R, 61.73, 61.41, 61.42, 61.43, 200/61.44

See application file for complete search history.

(56) References Cited

U.S. PATENT DOCUMENTS

| | | | | |
|---|---|---|---|---|
| 3,796,843 | A * | 3/1974 | Durkee et al. | 200/5 A |
| 3,971,902 | A | 7/1976 | Demler, Jr. et al. | |
| 4,319,099 | A * | 3/1982 | Asher | 200/5 A |
| 4,342,210 | A | 8/1982 | Denningham | |
| 4,463,234 | A * | 7/1984 | Bennewitz | 200/516 |
| 4,496,803 | A | 1/1985 | Smith | |
| 4,624,491 | A | 11/1986 | Vincent | |
| 4,762,348 | A | 8/1988 | Matsumoto | |
| 4,771,139 | A * | 9/1988 | DeSmet | 200/5 A |
| 4,864,085 | A * | 9/1989 | Hanajima et al. | 200/5 A |
| 5,475,192 | A * | 12/1995 | Inagaki et al. | 200/341 |
| 5,510,584 | A * | 4/1996 | Norris | 200/5 A |
| 5,654,687 | A | 8/1997 | LaBonde | |
| 5,717,429 | A | 2/1998 | Coulon et al. | |
| 5,775,142 | A | 7/1998 | Kim | |
| 5,821,482 | A | 10/1998 | Ootani et al. | |
| 5,967,297 | A | 10/1999 | Kaufman et al. | |
| 6,075,294 | A | 6/2000 | Van den Boom et al. | |
| 6,191,682 | B1 | 2/2001 | Wolfgang | |
| 6,465,752 | B1 * | 10/2002 | Meagher et al. | 200/61.73 |
| 6,494,615 | B1 | 12/2002 | Wyssbrod | |
| 6,689,973 | B1 * | 2/2004 | Meagher et al. | 200/61.73 |
| 6,886,012 | B1 * | 4/2005 | Phoenix et al. | 707/8 |

FOREIGN PATENT DOCUMENTS

| | | |
|---|---|---|
| EP | 1 221 517 | 7/2002 |
| FR | 2 382 759 | 9/1978 |
| JP | 2003223829 | * 10/2002 |

* cited by examiner

*Primary Examiner*—Michael Friedhofer
*Assistant Examiner*—Lisa Klaus
(74) *Attorney, Agent, or Firm*—Harness, Dickey & Pierce, PLC

(57) ABSTRACT

A switch assembly for triggering the release of a door latch that provides improved tactile feedback to a user when actuated is disclosed. The switch assembly provides a tactile response to the user that indicates proper actuation by the force feedback that is provided to the user as the button is displaced during actuation. The switch assembly includes an elastomeric button and a base supporting the button. An electrically conductive static contact is supported by the base. An electrically conductive moveable contact, also supported by the base, is operatively disposed between the button and the static contact. A film is disposed over the moveable contact and fixed to the edge of the base, sealing both contacts from the atmosphere. The film thereby effectively divides the interior of the switch assembly into an open first chamber located between the film and the button, and a closed second chamber located between the film and the base.

23 Claims, 5 Drawing Sheets

LOW PROFILE AUTOMOTIVE LATCH RELEASE SWITCH ASSEMBLY

FIELD OF THE INVENTION

The present invention relates generally to door mechanisms for automobile and other vehicle applications and, more particularly, to a switch assembly for an electromechanical door latch mechanism.

BACKGROUND OF THE INVENTION

Traditionally, mechanical devices have been used to latch and unlatch closures such as doors, trunks, hoods, lift gates and hatches and the like in automobiles and other vehicles. It is known, however, to utilize an electro-mechanical door latch mechanism for such applications for a variety of reasons including ease of operation, lower cost and weight, improved styling opportunities, and reduced complexity. For example, a user actuated switch can be employed to trigger the release of a mechanical latch. In this regard, an electrical switch is operable to provide an input to a controller for operating the mechanical latch when the switch is actuated. In addition, modern styling and ergonomic requirements may dictate the physical configuration of the switch. For example, the switch may need to comprise an aesthetically pleasing user actuation component (e.g., a low profile button) that is of adequate size and shape so as to be easily operated by a user under a wide variety of operating conditions in a wide variety of environments.

Known switch technology for such applications generally incorporates a button having a first electrically conductive material comprising protrusions having the shape of "pills" or spring-like "fingers" that are insert molded or otherwise attached to the underside of the button. A second electrically conductive material comprising a set of contacts is located opposite the button on a base portion of the switch assembly. The second electrically conductive material may typically be in the form of a plate, tracks or a printed circuit board, for example. The first electrically conductive material completes a circuit in the switch when the switch is actuated by depressing the button. For example, when the button is depressed, the first conductive material bridges the contacts of the second electrically conductive material thereby closing an electric circuit.

In one such known switch assembly configuration, the switch assembly is also sealed from the atmosphere. During its manufacture, a fixed volume air is captured in the space between the button and the base portion of the switch assembly. As such, when the ambient temperature of the switch assembly changes, so too does the volume of the air trapped within the switch assembly. Under hotter ambient temperature conditions the volume of air within the switch assembly expands; under colder ambient temperature conditions, the volume of air within the switch assembly contracts.

In such a design, changes in the switch assembly's operating environment, such as extreme changes in ambient temperature, for example, can impact the perceived operation of the switch to a user. For example, the switch assembly may not reliably provide satisfactory and perceptible tactile feedback to the user signifying actuation of the switch. In such a case, depression of the button may instead provide an unsatisfactory continuous resistance to the user causing the user to be unsure whether the switch has been properly actuated.

Consequently, it is desirable to provide a switch assembly having a reliable and cost-effective actuation mechanism that also provides satisfactory tactile feedback to a user for signifying proper actuation of the switch.

SUMMARY OF THE INVENTION

A switch assembly for triggering the release of a door latch that provides improved tactile feedback to a user when actuated is disclosed. In operation, the switch assembly closes a circuit that is monitored by a controller. Upon switch actuation, the controller operates a motor or solenoid, for example, to disengage a mechanical latch.

The switch assembly includes an elastomeric button and a base supporting the button. An electrically conductive static contact is supported by the base. An electrically conductive moveable contact, also supported by the base, is operatively disposed between the button and the static contact. A film is disposed over the moveable contact and fixed to the edge of the base, sealing both contacts from the atmosphere. The film thereby effectively divides the interior of the switch assembly into an open first chamber located between the film and the button, and a closed second chamber located between the film and the base.

Depression of the button deforms the button, the film and the moveable contact and brings the moveable contact into engagement with the static contact. Upon release of the button, the button, the film and the moveable contact return to their undeformed configurations, and the moveable contact disengages the static contact.

The switch assembly provides a tactile response to the user that indicates proper actuation. The tactile response is accomplished by the force feedback that is provided to the user as the button is displaced during actuation. In this regard, the button is depressed through a first range of travel that requires a first increasing amount of force, followed by a second range of travel that requires a decreasing amount of force, and concluding with a third range of travel that requires a second increasing amount of force.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
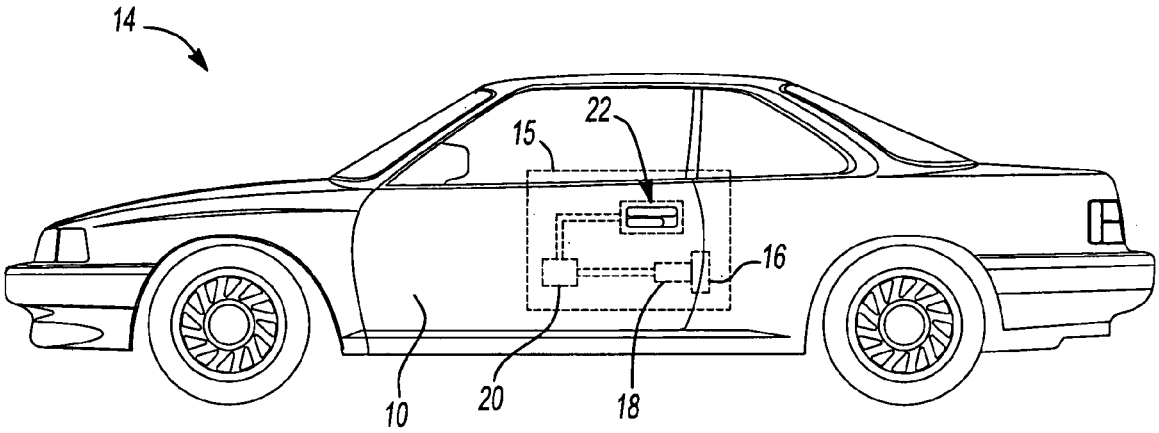
FIG. 1 is a side elevational view of an automobile showing a schematic representation of an electromechanical door latch mechanism in accordance with a preferred embodiment of the invention.

FIG. 1 shows an automobile 14 including a door 10 that is movable between an opened and a closed position. The door 10 is secured in the closed position by an electromechanical door latch mechanism 15. The electromechanical door latch mechanism 15 may comprise a user-actuated switch assembly 22, a controller 20 (e.g., a computer), a solenoid 18 (or, alternatively, an electric motor), and a mechanical latch 16 (which may or may not be integral to the solenoid 18).

In order to open the door 10, the latch mechanism 15 securing the door 10 must first be released. Release of the latch mechanism 15 is triggered by a user's manual actuation of the switch assembly 22. The switch assembly 22 provides a low-current electrical connection when actuated. The controller 20 monitors the switch assembly 22 for a change in state. When the controller 20 receives an input signal from the switch assembly 22, the controller 20 operates the solenoid 18 to disengage the mechanical latch 16, enabling the door 10 to be opened.

Although it is illustrated in FIG. 1 in the context of an automobile door, it should be appreciated that the latch mechanism 15 may be utilized for securing hoods, trunks, lift gates, sliding doors, hatches, or the like, on automobiles and other vehicles.

Figure 2:
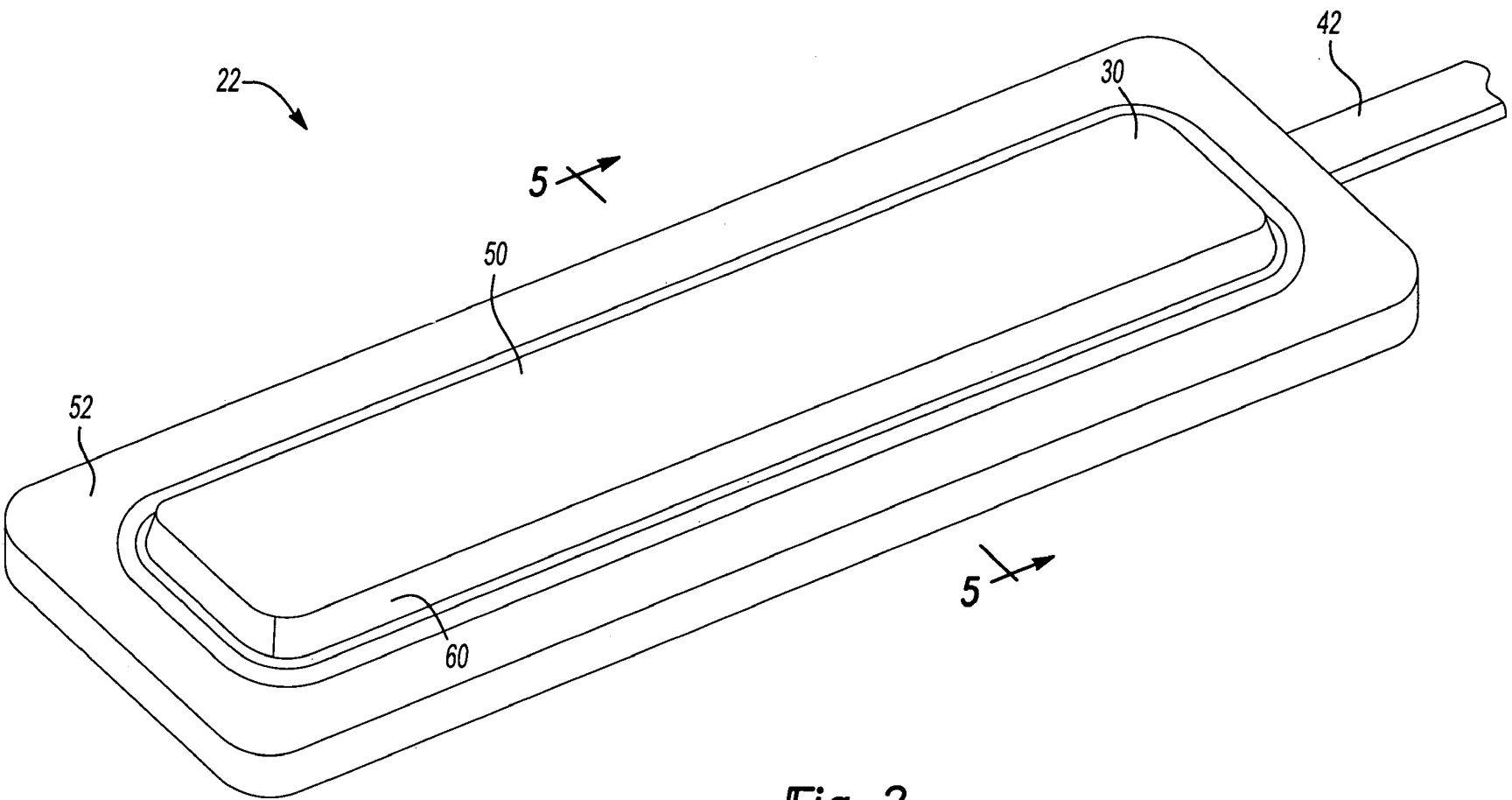
FIG. 2 is a perspective view of a switch assembly in accordance with a first preferred embodiment for use in the electromechanical door latch mechanism shown in FIG. 1.
Figure 3:
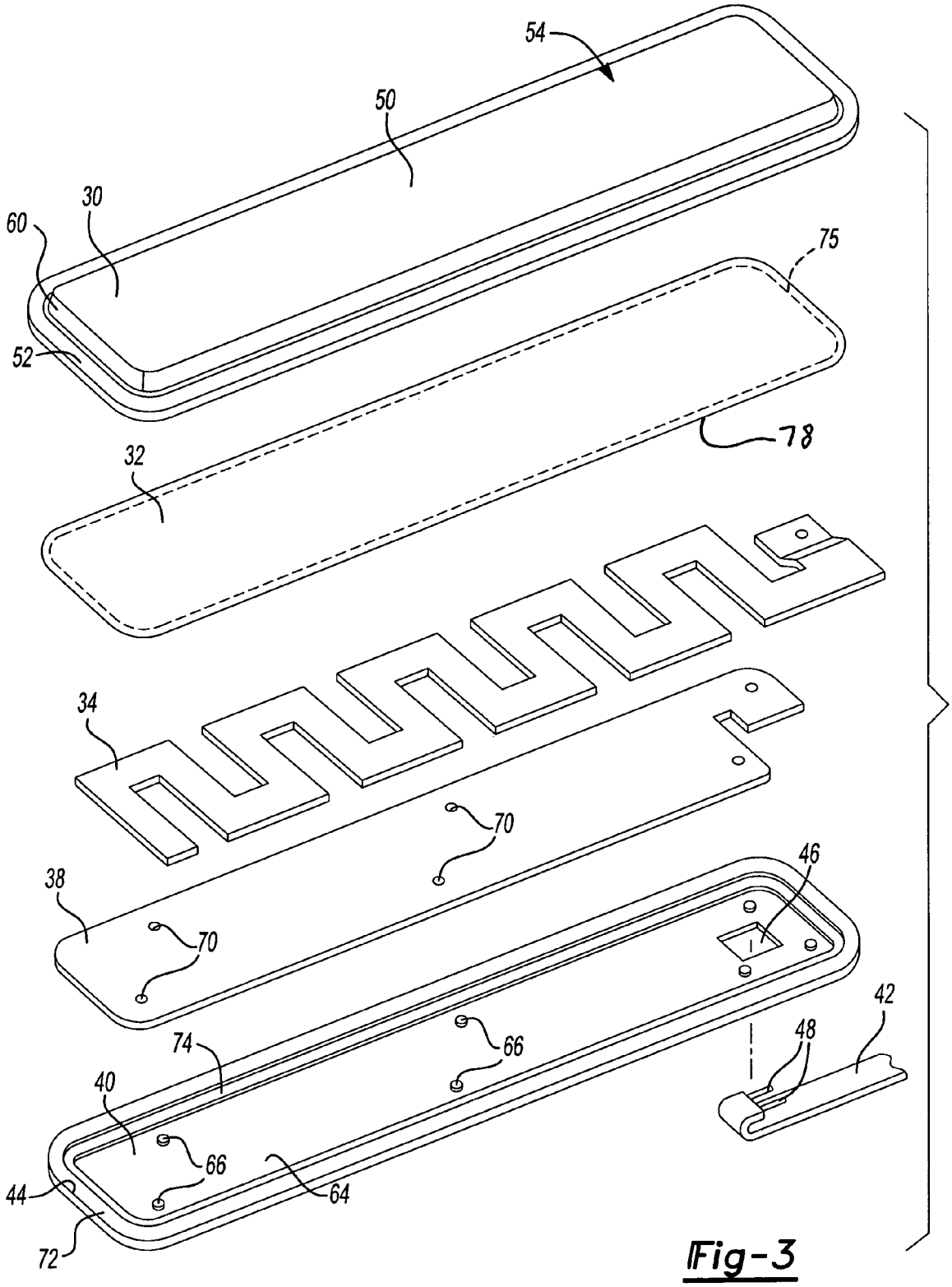
FIG. 3 is an exploded perspective view of the switch assembly shown in FIG. 2.

With reference to FIGS. 2 and 3, a switch assembly 22 according to a preferred embodiment of the invention is shown. The switch assembly 22 generally includes a button member 30, a film 32, a moveable contact 34, a static contact 38, a base member 40 and an electrical connector 42.

The button member 30 and the base member 40 are cooperable to form the outer shell of the switch assembly 22. The button member 30 is sized to fit around an outer perimeter 44 of the base member 40 in an assembled position. An aperture 46 is located in the base member 40 to provide access for the electrical connector 42. The aperture 46 is then sealed. In an assembled configuration, a pair of leads 48 from an end of the electrical connector 42 are electrically connected to the moveable contact 34 and the static contact 38, respectively.

The button member 30 is preferably of a unitary construction and is made from a flexible, elastomeric material. The wall thickness of the button member 30 may vary (as shown in the cross-sectional view of FIG. 5) to achieve the desired physical characteristics and operating features for the button member 30, as will become apparent from the discussion below.

The button member 30 generally includes a central actuation portion 50 and a peripheral flange portion 52. Located intermediate the actuation portion 50 and the flange portion 52 is a peripheral wall portion 60. The actuation portion 50 has an exterior surface or face 54, and an interior surface 56 (see FIG. 5). The actuation portion 50 generally has a material thickness that is greater than that of the wall portion 60. Consequently, the actuation portion 50 can be, relatively, stiffer than the wall portion 60.

Assembly of the button member 30 to the base member 40 is accomplished by the peripheral flange portion 52 of the button member 30. The peripheral flange portion 52 fits snugly around the outer perimeter 44 of the base member 40 and secures the button member 30 to the base member 40.

The wall portion 60 extends outwardly at an angle from the actuation portion 50 to the flange portion 52. The angle illustrated in the drawings is approximately 45 degrees from the plane defined by the exterior surface 54 actuation portion 50. It is appreciated that the wall 60 may define other angle(s) while maintaining the functionality of its construction, as is further described herein.

Figure 4:
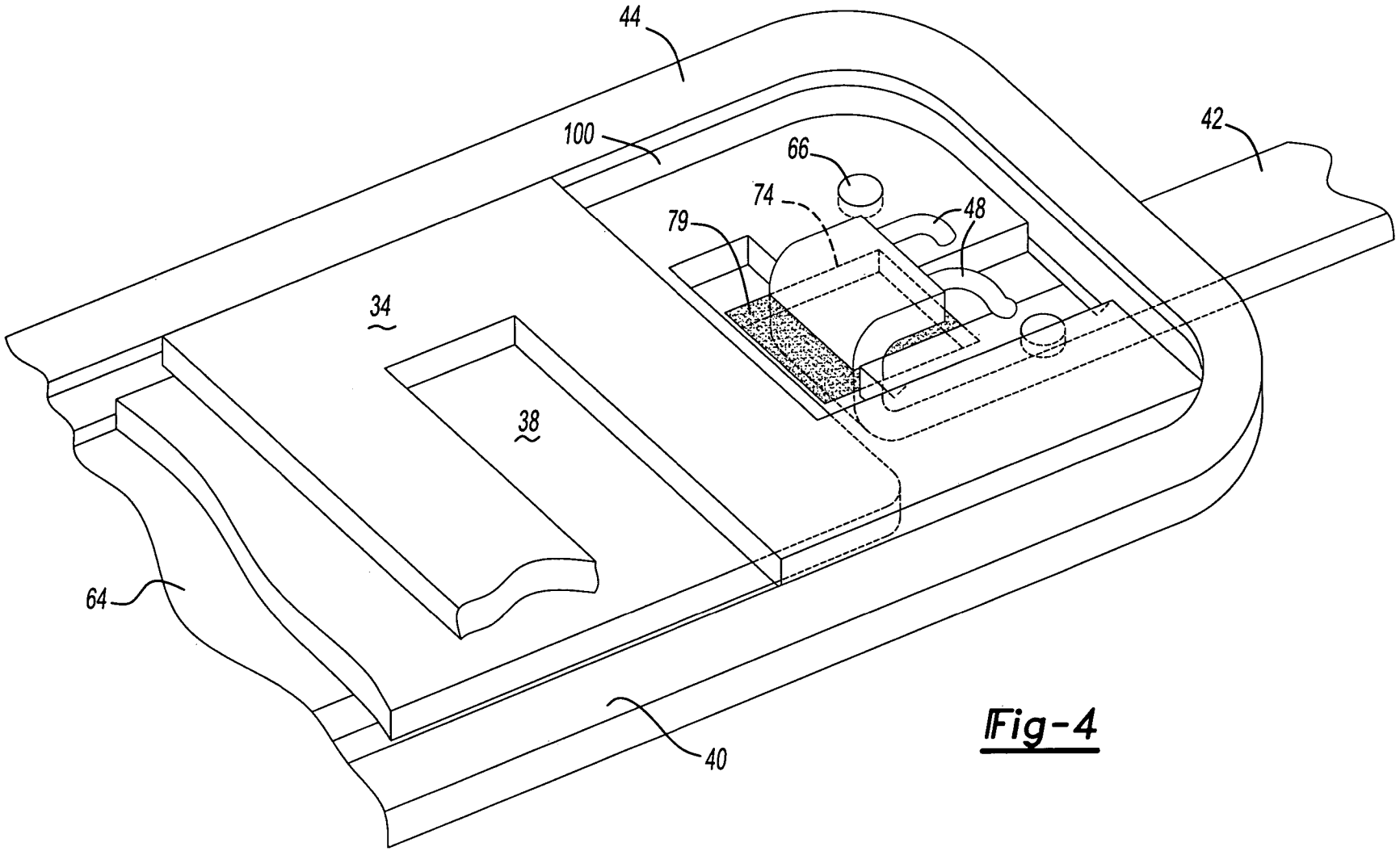
FIG. 4 is an enlarged, partial perspective view of the switch assembly of the invention with a button portion removed and showing an electrical connector connected to a movable contact and a static contact.
Figure 5:
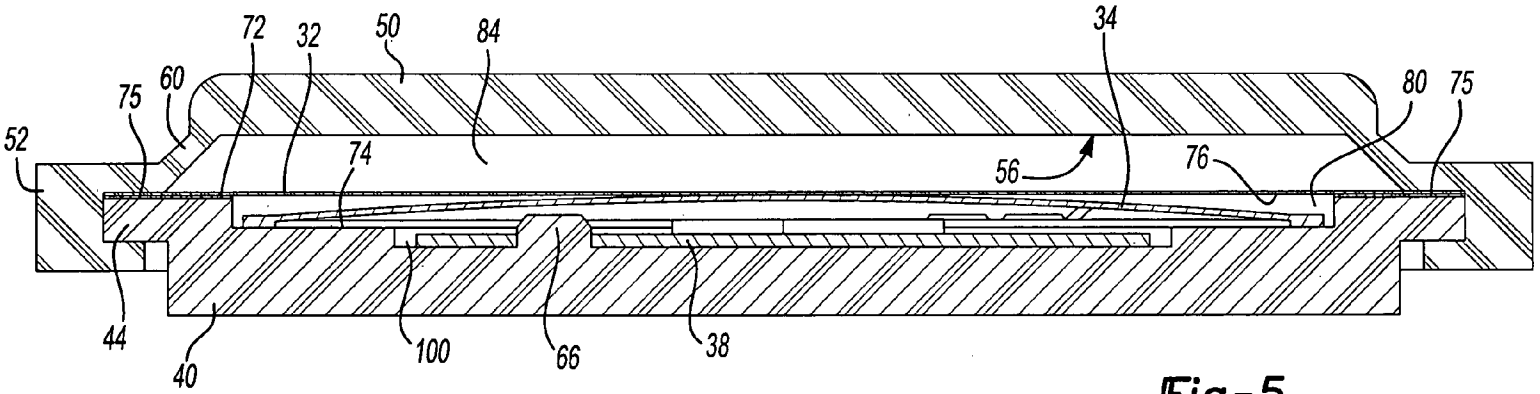
FIG. 5 is a cross-sectional side view of the switch assembly of FIG. 2 along the line 5—5.

Referring to the cross-sectional side view of FIG. 5, the base member 40 has a generally tiered configuration, comprising a plurality of ledges at different vertical levels, as viewed. A first, outer ledge 72 provides a surface for supporting the film 32. A second, intermediate ledge 74 is located inward and below of the outer ledge 72 and supports the moveable contact 34 in its position located between the film 32 and the static contact 38. An interior surface 64 (FIGS. 3–4) of the base member 40 supports the static contact 38 beneath both the film 32 and the moveable contact 34. The base member 40 may be made from a relatively rigid, lightweight material, such as plastic.

Illustrated in FIG. 3, a plurality of column-like projections or posts 66 are shown to project upward from an interior surface 64 of the base member 40. The projections 66 on the base member 40 are adapted to locate and secure the static contact 38 to the base member 40 by means of complementary apertures 70 in the static contact 38. It is appreciated that the static contact 38 may be alternatively located and secured to the base member 40 by any other suitable means. Although shown in the FIGS. as being generally cylindrical, it should be understood that the projections 66 and corresponding apertures 70 may take any desired geometric shape, such as square, rectangular, triangular, polygonal and the like.

The moveable contact 34 is shown to generally comprise a thin, ribbon-like electrically conductive material. As such, the moveable contact 34 can be made from and/or plated with a suitable electrically conductive material like the precious metals gold and silver. The ribbon preferably defines a pattern (for example, a serpentine pattern, as shown) to promote engagement with the static contact 38 upon depression of any part of the actuation portion 50 of the button member 30. That is, no matter where on the button member 30 the user presses, a portion of the moveable contact 34 will be able to come into engagement with the static contact 38.

The moveable contact 34 also preferably possesses spring-like characteristics, enabling it to deflect or deform when forced into engagement with the static contact 38 by depression of the button member 30 and then return to an undeflected or undeformed configuration when the depression force is removed. As shown in FIG. 5, the moveable contact 34 is arched or bowed away from the static contact 38 and toward the film layer 32 such that it is biased against the depression force put on the button member 30 during actuation of the switch assembly 22.

The film 32 encloses the moveable contact 34 and static contact 38 within a space between the film 32 and the base member 40. The film 32 is adhered or otherwise sealingly fixed about its perimeter to the base member 40 at the outer ledge 72. For example, the film 32 can be laminated about its perimeter with an adhesive material 75 on a portion of an undersurface 78 (shown in FIG. 3). The adhesive material 75 is then sandwiched between the film 32 and the ledge 72 of the base member 40 to create an air-tight seal between the film 32 and the base member 40.

As already mentioned, the passage 46 in the base member 40 is also sealed during assembly. For example, a sealing agent such as epoxy 79 can be deposited at the passage 46 in the base member 40 and around the electrical connector 42 to form an air-tight seal (see FIG. 4).

The film 32 is thin, flexible and is capable of deflecting or deforming under a load, but retaining its original configuration when the load is removed. A polyester film such as, but not limited to, Mylar® manufactured by the Dupont Corporation, is a suitable material for the film.

The seal provided between the film 32 and the base member 40 interface, as well as the seal provided at the passage 46 creates a small-volume, air-tight chamber 80 (see FIG. 5). The air-tight chamber 80 closes the moveable contact 34 and the static contact 38 from the atmosphere. The volume of air sealed in the air-tight chamber 80 is minimal and design parameters for the moveable contact 34 may be altered or modified to accommodate changing requirements without affecting performance of the switch assembly 22. Moreover, extreme changes in the ambient environment of the switch assembly 22, such as extreme temperature changes have negligible, if any, affect on the operation of the switch assembly 22 because of the very small volume of air in the air tight chamber 80.

As already discussed, once assembled, the peripheral flange portion 52 of the button member 30 is wrapped around the outer perimeter 44 of the base member 40. The elastomeric properties of the button member 30 promote a gripping action between the button member 30 at the interface with the base member 40. However, air can pass between the peripheral flange portion 52 and the outer perimeter 44 during depression and release of the button member 30. A vented chamber 84 (see FIG. 5) is therefore created, comprising the space enclosed between the button member 30 and the film 32 of the switch assembly 22, that is not sealed from the atmosphere. Consequently, the switch assembly 22 includes two chambers—an air-tight chamber 80 and a vented chamber 84.

The elastomeric properties of the button member 30 together with the two chamber configuration (vented and sealed) of the switch assembly 22 cooperate to provide desirable tactile feedback to a user during operation of the switch assembly 22. With reference to FIGS. 5–7 and FIG. 8, the operation of the switching assembly 22 will be described.

Figure 6:
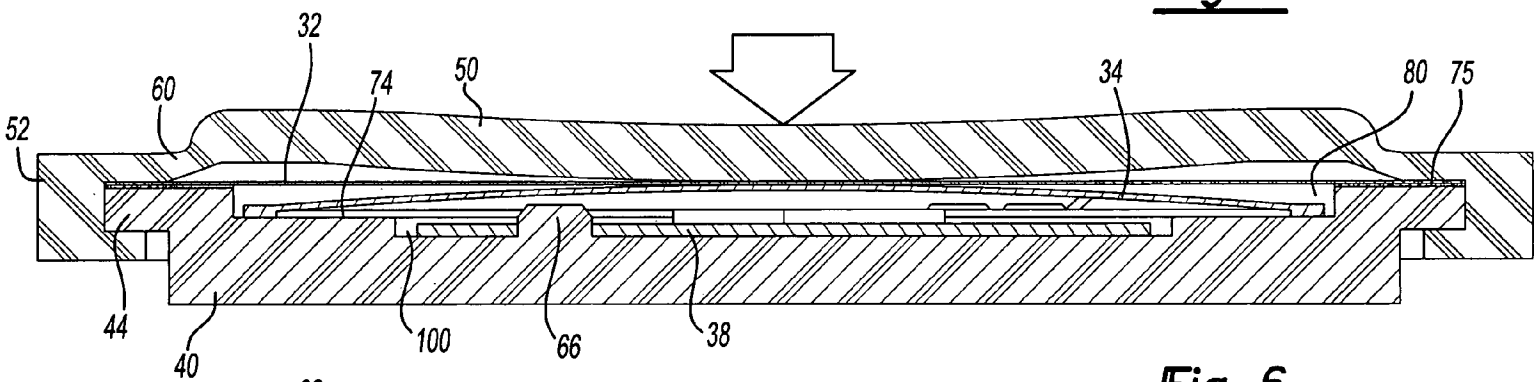
FIG. 6 is a cross-sectional side view of the switch assembly of FIG. 2 as shown in FIG. 5, wherein the button has been partially depressed.

FIG. 5 illustrates the switch assembly 22 in an open, non-actuated position. FIG. 6 shows the button member 30 of the switch assembly 22 partially deformed and depressed to an intermediate position just touching the film 32. Displacement of the button member 30 from the open, non-actuated position (FIG. 5) to the intermediate position (FIG. 6) forces air contained in the vented chamber 84 to escape from the chamber 84 at the interface between the peripheral flange portion 52 and the outer perimeter 44.

Figure 7:
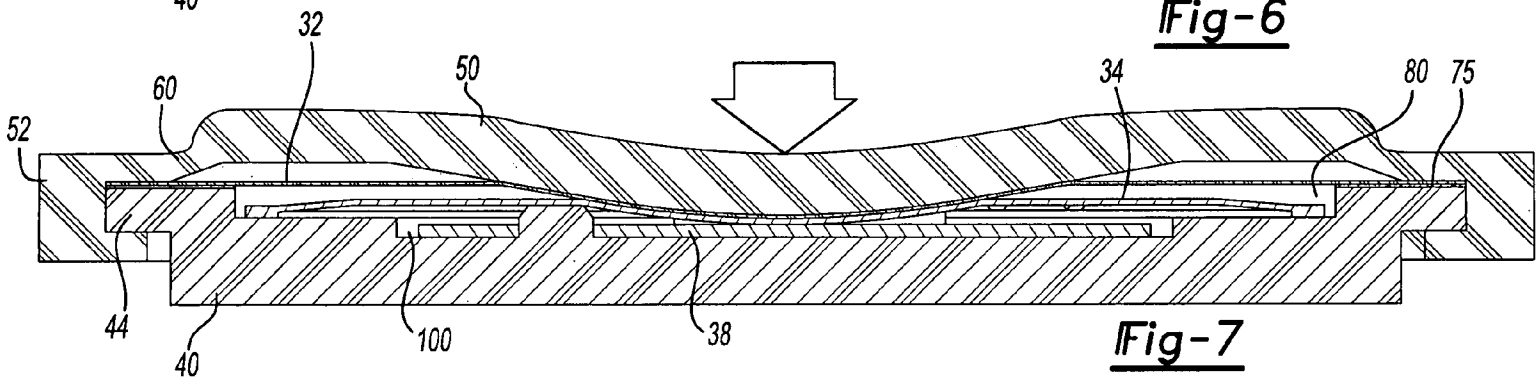
FIG. 7 is a cross sectional side view of the switch assembly of FIG. 2 as shown in FIG. 6, wherein the button has been further depressed beyond that shown in FIG. 6 to a position resulting in engagement between the moveable contact and the static contact.

Further depression of the button member 30 causes continued movement of the button member 30 from the intermediate position (FIG. 6) to the actuated position (FIG. 7). Displacement of the button member 30 to the actuated position (FIG. 7) causes the film 32 and moveable contact 34 to deflect toward the static contact 38 until the moveable contact 34 engages static contact 38 thereby completing the circuit.

The movement of the button member 30 from the intermediate position (FIG. 6) to the actuated position (FIG. 7) causes the volume of air in the air-tight chamber 80 to be at least partially compressed and or redistributed beneath the film 32. A gap 100 (FIG. 4) is provided at a peripheral boundary between the static contact 38 and the base member 40 to accommodate a portion of air volume in the air-tight chamber 80 to ensure the adhesive seal 75 at the interface between the film 32 and the base member 40 is not compromised.

Figure 8:
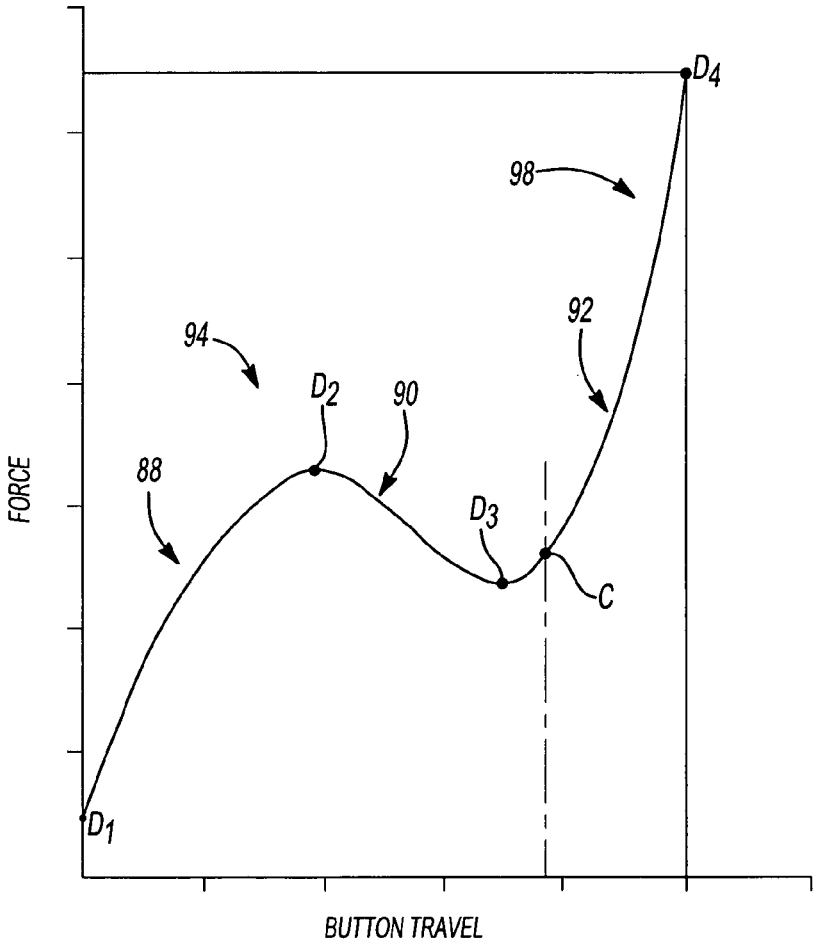
FIG. 8 is a graph illustrating a force/displacement curve of the switch assembly of the invention.

The graph illustrated in FIG. 8 plots the actuation force required to depress the button member 30 versus travel of the button member 30 during operation of the switch assembly 22. Point $D_1$ represents the point of initiation of switch actuation by the user (FIG. 5). At $D_1$, the button member 30 has not moved, and an actuation force is required to initiate movement of the button member 30. At point $D_2$ the button member's 30 resistance to travel begins to decrease, such as when the wall portion 60 collapses or buckles. The force required by the user also begins to decrease. Point $D_3$ represents a point in the continued travel of the button member 30, just before the button member 30 first contacts the film 32, where the button member's 30 material properties and design configuration cause the actuation force to begin to increase, such as when the wall portion 60 becomes taught as a result of continued depression of the button member 30. Point C represents the point at which the button member 30 just makes first contact with the film 32 (FIG. 6). Point $D_4$ represents engagement between the moveable contact 34 and the static contact 38 and the button member 30 is precluded from further travel (FIG. 7).

As shown, the graph depicts three distinct areas of force progression during actuation of the switch assembly 22. More specifically, the graph defines a first increasing force range 88 (from point $D_1$ to $D_2$), an intermediate decreasing force range 90 (from point $D_2$ to $D_3$), and a final increasing force range 92 (from point $D_3$ to $D_4$).

In addition, in moving from its initial position (FIG. 5) to its intermediate position (FIG. 6) the button member 30 collapses the vented chamber 84 until it just contacts the film 32. This button travel, which is from point D, to point C, defines a vented range identified at reference 94 in FIG. 8. The material properties and design configuration of the button member 30, together with the escape of air from the vented chamber 84, substantially oppose the actuation force during the vented range 94.

Displacement of the button member 30 from point C to point $D_4$ defines a sealed range identified at reference 98 in FIG. 8. It is presently contemplated that travel in the sealed range 98 will take place entirely within the final increasing range 92. In the sealed range 98, in addition to the material properties and design configuration of the button member 30, the spring-like properties of the film 32 and moveable contact 34, and the compression of the air in the air-tight chamber 80, also oppose the actuation force.

As represented in FIG. 8, about three-fourths of the total travel of the button member 30 occurs during the vented range 94. Consequently, only about one-fourth of the total travel of the button member 30 occurs during the air-tight range 98, through depression of the moveable contact 34 into engagement with the static contact 38. Total travel of the button member 30 through said first, second and third range of travel can collectively defines about 1.5 mm.

When the moveable contact 34 engages the static contact 38, the switch assembly 22 closes electrically. When the button member 30 is released (i.e., the actuation force is removed), the button member's 30 design configuration and material properties cause it to return back to its undeflected/undeformed, non-actuated configuration (FIG. 5). Likewise, the spring-like characteristics of the film 32 and the moveable contact 34, cause the film 32 and the moveable contact 34 to return their undeflected/undeformed positions breaking engagement between the moveable contact 34 and the static contact 38 and opening the switch.

The configuration of the switch assembly 22 of the present invention provides desirable tactile feedback to the user. The switch assembly 22 of the invention causes the user to experience a variable sequence of force to accomplish actuation of the switch. During depression of the button member 30, the user experiences an initial increase of force (range 88) followed by an appreciable decrease in force (range 90), and finally an increase in force (range 92). Progression of the button member 30 through this sequence provides appreciable feedback to the that a successful actuation has been completed.

Those skilled in the art can now appreciate from the foregoing description that the broad teachings of the present invention can be implemented in a variety of forms. Therefore, while this invention has been described in connection with particular examples thereof, the true scope of the invention should not be so limited since other modification will become apparent to the skilled practitioner upon a study of the drawings, specification and following claims.

What is claimed is:

1. A switch for a door latch actuation mechanism, wherein operation of a door latch is initiated in response to actuation of the switch, the switch comprising:

a button;

a base supporting said button, said base comprising a first ledge, said button and said base cooperable to define an interior space of said switch;

an electrically conductive static contact coupled to a control and supported by said base;

an electrically conductive moveable contact operatively disposed intermediate said button and said static contact and supported by said base;

a film disposed over said moveable contact and supported about its periphery on said first ledge, said film cooperable with said base to form an air-tight chamber sealing both said static contact and said moveable contact from the atmosphere; and wherein the depression of said button causes said moveable contact to engage said static contact to close a circuit and initiate operation of the door latch.

2. The switch of claim 1 wherein said button includes a peripheral wall and wherein said wall collapses when said button is subject to an actuation force.

3. The switch of claim 1 wherein said base comprises a second ledge and said moveable contact is supported on said second ledge.

4. The switch of claim 3 wherein said moveable contact comprises a spring that is biased to oppose an actuation force.

5. The switch of claim 1 wherein said film is adhesively bonded to said first ledge.

6. The switch of claim 5 wherein said film comprises polyester.

7. The switch of claim 1 further comprising an electrical connector and wherein said base comprises a passage for providing access by said electrical connector to said static contact and said moveable contact.

8. A switch for a door latch actuation mechanism, wherein operation of a door latch is initiated in response to actuation of the switch, the switch comprising:

a button;

a base supporting said button, said button comprising a peripheral flange and said base comprising an outer perimeter, said flange wrapping around said perimeter, wherein said button and said base cooperate to define an interior space of said switch;

an electrically conductive static contact coupled to a control and supported by said base;

an electrically conductive moveable contact operatively disposed intermediate said button and said static contact and supported by said base;

a film fixed to said base, said film cooperable with said base to form an air-tight chamber sealing both said static contact and said moveable contact from the atmosphere; and wherein the depression of said button causes said moveable contact to engage said static contact to close a circuit and initiate operation of the door latch.

9. The switch of claim 8 wherein said button includes a peripheral wall and wherein said wall collapses when said button is subject to an actuation force.

10. The switch of claim 8 wherein said base comprises a first ledge and said film is supported about its periphery on said first ledge, said base further comprising a second ledge wherein said moveable contact is supported on said second ledge.

11. A switch assembly for closing an electric circuit and actuating a door latch, the switch assembly comprising:

an elastomeric button;

a base supporting said button;

an electrically conductive static contact coupled to a control and supported by said base; and an electrically conductive moveable contact operatively disposed between said button and said static contact;

wherein closing of the electric circuit is accomplished by sequential depression of said button through a first range of travel requiring an increasing amount of force followed by a second range of travel requiring a decreasing amount of force and concluding with a third range of travel requiring an increasing amount of force.

12. The switch assembly of claim 11 wherein said button includes a peripheral wall and wherein the transition from said first range of travel to said second range of travel substantially coincides with the deflection of said peripheral wall in response to an actuation force.

13. The switch assembly of claim 12 wherein depression of said button through said first, second and third range of travel collectively defines about 1.5 mm of travel.

14. The switch assembly of claim 13 wherein said first range of travel and second range of travel collectively defines about three-fourths of total travel of said button.

15. The switch assembly of claim 14 wherein said button and said base are cooperable to define and interior space of said switch assembly and said switch assembly further comprising a film disposed over said moveable contact and fixed to said base, said film cooperable with said base to form an air-tight chamber sealing both said static contact and said moveable contact from the atmosphere, a remainder of said interior space comprising a chamber vented to atmosphere.

16. The switch assembly of claim 15 wherein said first range of travel and second range of travel depresses said button through said chamber vented to atmosphere.

17. The switch assembly of claim 16 wherein said third range of travel compresses said air-tight chamber and causes said moveable contact to engage said static contact.

18. An electro-mechanical door latch system for an automotive vehicle comprising:

a motor mounted in a vehicle door, said motor operationally releasing a door latch to allow said vehicle door to be opened;

a vehicle computer coupled to said motor, said computer controlling the operation of said motor; and a switch coupled to said vehicle computer, wherein actuation of said switch closes a circuit monitored by said vehicle computer, the switch including:

an elastomeric push button;

a bass supporting said button, said base and said button cooperable to create an interior space of said switch;

a pair of contacts supported by said base;

a film disposed over said pair of contact and fixed to said base, said film cooperable with said base to form an air-tight chamber sealing said pair of contacts from the atmosphere, said remainder of said interior space comprising a chamber vented to atmosphere; and wherein actuation of the latch accomplished by sequential depression of said button through a first range of travel requiring an increasing level of force followed by a second range of travel requiring a decreasing level of force and conducting with a third range of travel requiring an increasing level of force.

19. The electromechanical door latch system of claim 18 wherein said pair of contacts comprises a static contact supported on said base and a moveable contact supported on said base and located intermediate said film and said static contact.

20. The electromechanical door latch system of claim 18 wherein depression of said button through said first and second range of travel collectively defines about three-fourths of total travel of said button.

21. A switch assembly for actuating a door latch, the switch assembly comprising:

a depressible button;

a stationary electrical contact; and a moveable electrical contact displaceable by depression of said button;

wherein said button is depressible through a first range of travel requiring an increasing amount of force, and a second range of travel requiring a decreasing amount of force, and a third range of travel requiring an increasing amount of force;

and wherein said moveable electrical contact is operable to close an electric circuit comprising said stationary electrical contact and said moveable electrical contact when said moveable electrical contact is displaced by said button.

22. The switch assembly of claim 21 further comprising:

a base supporting said button, said button and said base being cooperable to define an interior space of said switch assembly; and a film disposed over said moveable electrical contact and attached to said base, said film cooperable with said base to form an air-tight chamber sealing both said stationary contact and said moveable contact from the atmosphere, a remainder of said interior space comprising a chamber vented to atmosphere.

23. The switch assembly of claim 22 wherein depression of said button through both said first range of travel and second range of travel displaces said button through said chamber that is vented to atmosphere.

* * * * *